US007559547B2

(12) United States Patent
Van Dongen et al.

(10) Patent No.: US 7,559,547 B2
(45) Date of Patent: Jul. 14, 2009

(54) TRAY FOR NON-UNIFORM THICKNESS OBJECTS

(75) Inventors: Richard A. Van Dongen, Newark, NY (US); Stephen A. Demchock, Rochester, NY (US); Raymond D. Wilcox, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 459 days.

(21) Appl. No.: 11/111,823

(22) Filed: Apr. 22, 2005

(65) Prior Publication Data

US 2006/0284366 A1 Dec. 21, 2006

(51) Int. Cl.
*B65H 1/08* (2006.01)

(52) U.S. Cl. ..... 271/148; 271/213; 271/160

(58) Field of Classification Search ..... 271/207, 271/209, 213, 214, 215, 217, 218, 219, 160, 271/162, 163, 164, 148, 3.01, 3.08
See application file for complete search history.

(56) References Cited

U.S. PATENT DOCUMENTS 3,280,822 A * 10/1966 Pipe ..... 211/51
5,364,087 A * 11/1994 Schieck et al. ..... 271/148
5,934,667 A * 8/1999 Miki ..... 271/152

FOREIGN PATENT DOCUMENTS

| | | | |
|---|---|---|---|
| JP | 59-78013 | * | 5/1984 |
| JP | 3-216424 | * | 9/1991 |
| JP | 4-144878 | * | 5/1992 |
| JP | 2004-51349 | * | 2/2004 |

OTHER PUBLICATIONS

English translation of Japanese Publication No. 3-216424 (Kosugi).*

* cited by examiner

*Primary Examiner*—Patrick H Mackey
*Assistant Examiner*—Thomas A Morrison
(74) *Attorney, Agent, or Firm*—Oliff & Berridge, PLC

(57) ABSTRACT

Techniques are disclosed for supporting objects in a tray and moving different portions of the objects at different rates for inputting or outputting from an objects processor. These techniques may be applied to stacking objects that has a thickness at one end greater than the thickness at another end, for example, resulting in stacking height of the thicker end increasing faster than the stacking height of the other thinner end.

12 Claims, 8 Drawing Sheets

TRAY FOR NON-UNIFORM THICKNESS OBJECTS

BACKGROUND

Machines that process stacked objects and output the processed items also in a stack are common. For example, printing industry systems commonly stack blank recording mediums and feed them into printing processors and stack printed outputs. This type of stacking/processing/stacking sequence may also be found in common office equipment such as xerographic copiers or printers.

SUMMARY

Techniques are disclosed for supporting objects in a tray and moving different portions of the supported objects at different rates for inputting to or outputting from an objects processor. These techniques may be applied to stacking objects that has a thickness at one portion greater than the thickness at another portion, for example, resulting in stacking height of the thicker portion increasing faster than the stacking height of the other thinner portion. In xerographic printing or copying systems, for example, these techniques provide support for stacking recording mediums in a tray that accommodates the variation of stacking heights so that a particular desirable relationship between the recording medium on top of the stack may be maintained with respect to a feeder mechanism that either removes recording mediums from the stack and inputting them into a printer or copier, or receiving the recording mediums from the printer or copier and stacking them in a thickness variable accommodating manner.

A particular implementation provides an arm having a free end and a pivot end for moving different portions of stacked recording mediums at different rates. The free end may be provided with an appropriate surface shape to support the recording medium while the pivot may be provided with a structure that allows the arm to slide and rotate on a pivot guide, for example. The recording medium support may rest, on a tray lift so that as the tray lift moves up and down, different portions of recording mediums stacked above the support may be moved at different rates.

Multiple pivot points may also be used so that an arm may pivot about a pivot support at one of two ends and pivot about a second pivot support at an intermediate point between the two ends so that rotational movement may be controlled relative to a separate recording medium support surface. Other techniques may be used such as different size gears and racks attached either to the support for recording mediums or the frame of the tray so that different portions of the support for the recording medium may be moved at different rates. Multiple arms could also be used to adjust movement rates at different portions of the support for the recording medium.

Using the various techniques discussed above, documents having non-uniform thicknesses such as docucards, for example, may be stacked in a tray so that the uppermost recording medium may be maintained at a particular position for proper feeding of the recording medium into a processor such as a printer or to accept processed recording mediums into a stacker.

BRIEF DESCRIPTION OF THE DRAWINGS

Various disclosed exemplary embodiments of the systems and methods will be described in detail, with reference to the following figures, wherein.

DETAILED DESCRIPTION OF EMBODIMENTS

As discussed above, many types of machines process objects that are stacked in an input tray, and each object of the stack may be input into the processing machine, processed and output to an output stacker. For ease of discussion, a print machine such as a xerographic copier or printer is used as an example to illustrate various features related to the input and output trays.

Figure 1:
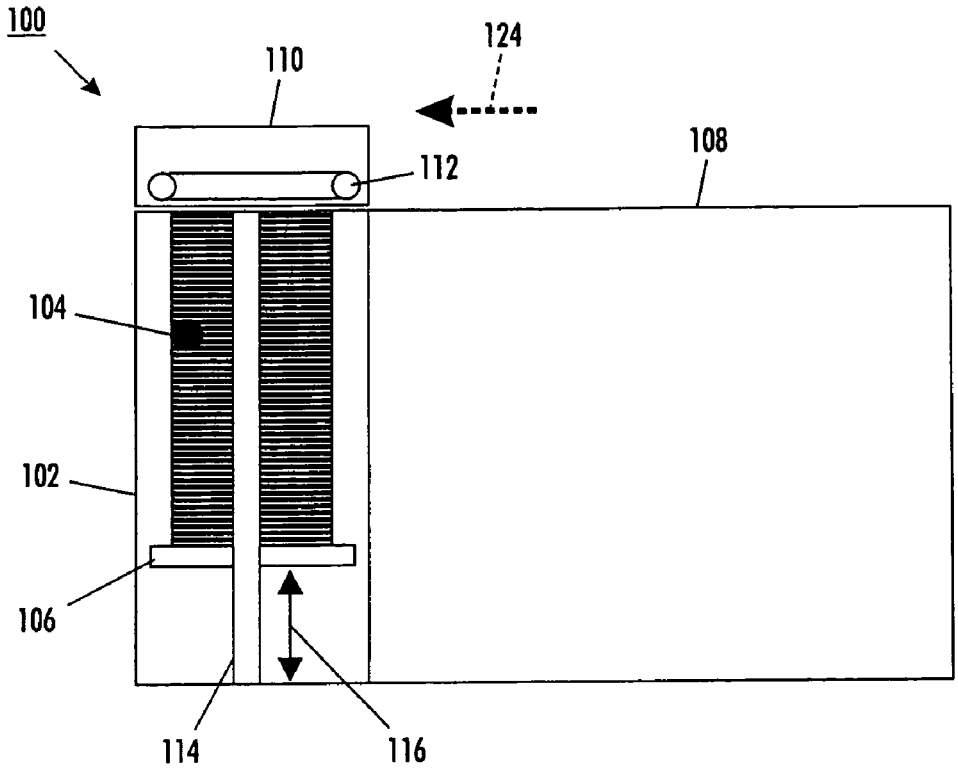
FIG. 1 shows an example of a feed tray coupled to a processing machine.

FIG. 1 shows an exemplary diagram of an office device such as a xerographic printer 100 that may include a feed tray 102, a feeder 110 and a print machine 108. The feed tray includes a tray lift 106 that may be guided by a lift guide 114. Recording medium 104 may be stacked above the tray lift and moved in a substantially linear movement directions 116.

Recording medium 104 may have substantially uniform thickness and tray lift 106 lifts the stack of recording mediums 104 upwards so that a belt assembly 112, for example, of feeder 110 may separate a top recording medium from the stack and feed the top recording medium into print machine 108 for processing.

Feed tray 102 shown in FIG. 1 may be efficient for recording mediums 104 that have substantially uniform thickness. However, if the thickness distribution of the recording medium is not substantially uniform, then the interaction between the top recording medium and belt assembly 112 may become complicated and may result in various difficulties such as misfeeds, etc. Although interface requirements between the top recording medium and belt assembly 112 may vary depending on different types of feeding mechanisms, it is usually a requirement that the top surface of the top recording medium is substantially parallel to (or flat relative to) a bottom surface of belt assembly 112 so that sufficient contact may be provided between belt assembly 112 and the top surface of the top recording medium to achieve the feeding process. In addition, a leading edge of the top recording medium usually must be aligned with an input port of the print machine 108 to achieve successful feeds. Thus, when recording medium 104 is thicker at one end than at other portions, the top surface of the top recording medium of a stack of such recording mediums may have one end that is substantially closer to belt assembly 112 than its remaining portion due to accumulated thicknesses of the complete stack of recording mediums.

Figure 2:
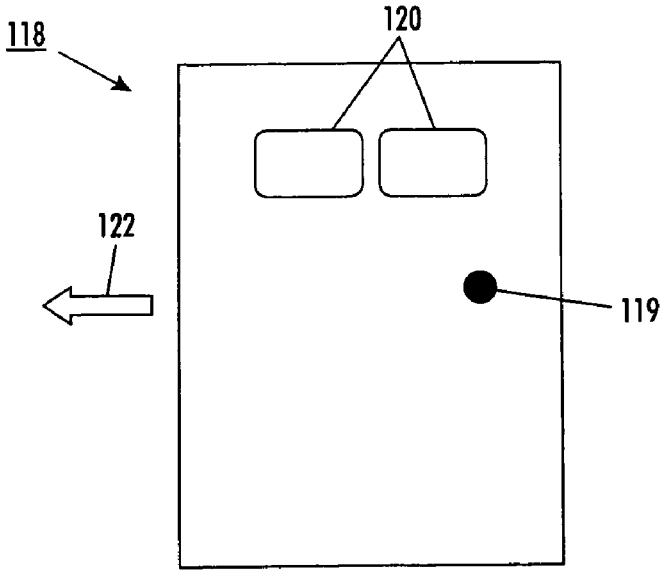
FIG. 2 shows an example of an object to be processed such as a docucard.

Docucard is an example of such a document having non-uniform thicknesses across its surface. As shown in FIG. 2, a docucard recording medium 118 may include cards 120 such as plastic credit cards mounted at particular positions on a substrate 119 such as paper, for example. When placed into a tray, docucard 118 may be fed by belt assembly 112 into print machine 108 in a direction 122 as indicated by the arrow.

Figure 3:
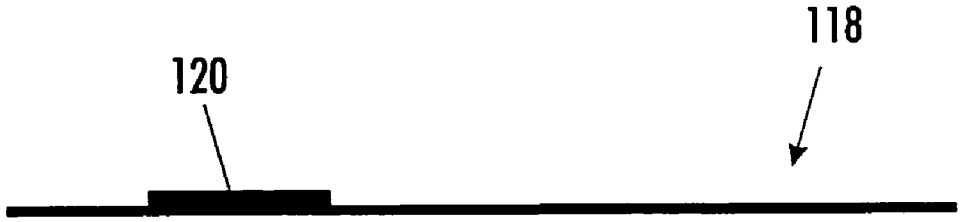
FIG. 3 shows an exemplary profile of the docucard.
Figure 4:
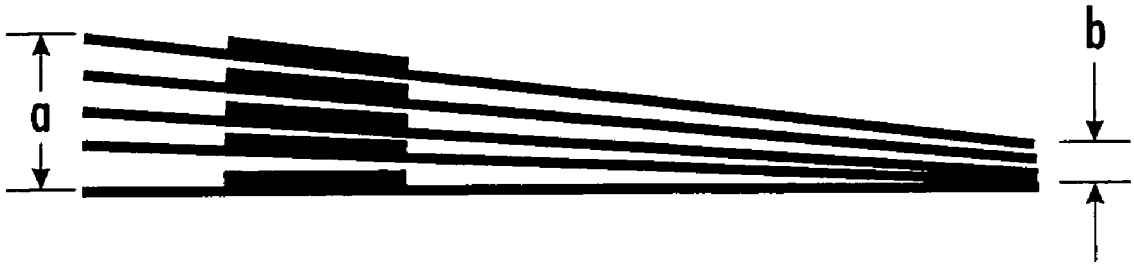
FIG. 4 shows an exemplary stack of docucards.

FIG. 3 shows an exemplary profile of docucard 118. Cards 120 have thicknesses that are comparable if not greater than the thickness of substrate 119. Thus, when stacked as shown in FIG. 4, the portion of docucards 118 that include cards 120 may stack to a thickness "a" while portions that do not include cards 120 may stack to a thickness "b," and a>b. Thus, when docucards 118 are placed into a feed tray such as feed tray 102, the stacking height on one side would be much greater than the stacking height on the other side. The top surface of the top docucard would contact belt assembly 112 in a non-uniform way and the leading edge of the docucard that feeds into print machine 108 would also be improperly aligned causing feeding errors, for example.

Figure 5:
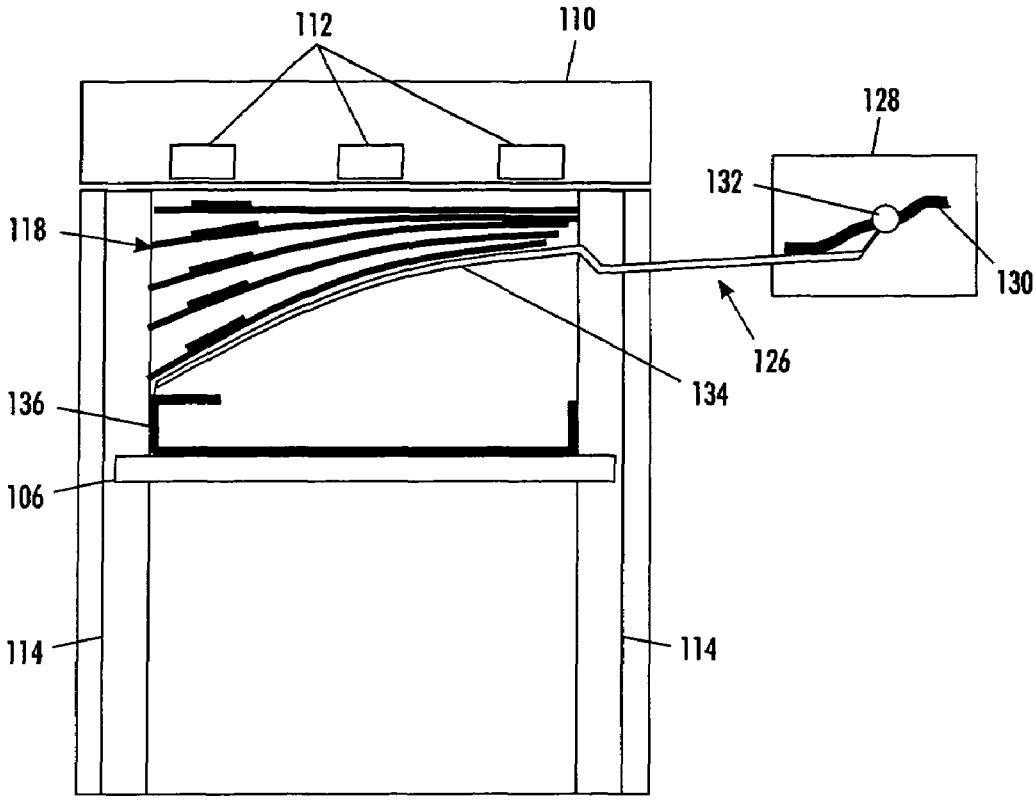
FIG. 5 shows an exemplary docucard feed tray.

FIG. 5 shows an exemplary view from a direction 124 of feed tray 102. The feed tray 102 may be fitted with an arm 126 and a spacer 136 so that recording mediums with non-uniform thicknesses such as docucards 118 may be stacked to maintain a desirable relationship between the top recording medium, belt assembly 112 and input port of print machine 108. Arm 126 may include a pivot 132 at one end and a recording medium support 134 at the other end. Pivot 132 may be coupled to a pivot guide 130 that may be supported on a pivot guide support 128. A free end of recording medium support 134 may rest on spacer 136. Spacer 136 and pivot guide 130 are dimensioned to maintain the top recording medium in a desired position relative to belt assembly 112. Spacer 136 may be supported by tray lift 106 so that spacer 136 and arm 126 move in response to the movement of tray lift 106.

Pivot 132 permits arm 126 to move angularly as well as translationally. As tray lift 106 moves downward, the free end of recording medium support 134 follows the downward movement and arm 126 rotates about pivot 132. However, the contact between arm 126 and spacer 136 remain substantially in the same position as tray lift 106 moves downward thus causing pivot 132 to slide, guided by pivot guide 130. As shown, pivot guide 130 may cause pivot 132 to move through an arbitrary curve so that recording medium support 134 may maintain a desired position to support the recording medium so that the top recording medium may maintain a desired position relative to belt assembly 112 of feeder 110.

Pivot guide 130 may be a slot and pivot 132 may be a pin inserted into the slot of pivot guide 130. As tray lift 106 moves downward, arm 126 angularly rotates about pivot 132 and pivot 132 slides in the slot of pivot guide 130 thus adjusting the position of recording medium support 134. Pivot guide 130 may also be a cam riding surface and pivot 132 may be a cam sliding down the cam riding surface of pivot guide 130. Pivot 132 may be held to the cam riding surface by the weight of arm 126. Arm 126 and spacer 136 may be disposed in feed tray 102 as an insert so that feed tray 102 that is normally used to feed recording medium 104 of uniform thickness may be quickly adapted for feeding recording medium of non-uniform thickness such as docucards 118 by simply inserting spacer 136 and arm 126.

Figure 6:
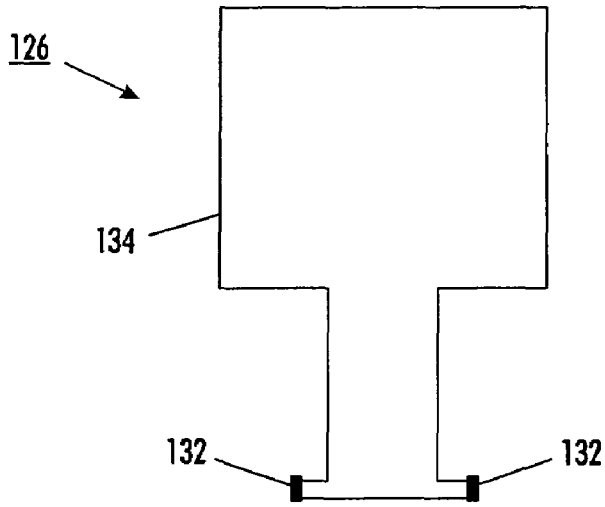
FIG. 6 shows an exemplary top view of the arm shown in FIG. 5.

FIG. 6 shows a top view of arm 126. Recording medium support 134 may have a shape that corresponds to the shape of the recording medium such as docucard 118. The length of arm 126 may be adjusted as required depending on thickness variations of the recording medium. Pivot 132 may be disposed at edges of an end of arm 126, as shown in FIG. 6, and pivot support 130 may be a slot or cam surface or other guide mechanisms to control the position of pivot 132 to achieve proper positioning of arm 126 relative to feeder 110 and print machine 108.

While the above discussion used printer machine 108 and docucard 118 as examples, arm 126 and spacer 136 may be used in feeder applications of other types of machines. Arm 126 may provide variations in movement of recording medium support 134 (or object support) so that different portions of the recording medium (or object) may be stacked at different heights depending on a number of the recording mediums (or objects) that are stacked. In the docucard example, substantially linear movement in directions 116 of the card end of docucard 118 is greater than the opposite end that does not include cards 120. Thus, the greater stacking height required to accommodate the card thickness is accommodated so that the recording medium on top of the stack is maintained at a controlled relationship with respect to feeder 110 and print machine 108.

Figure 7:
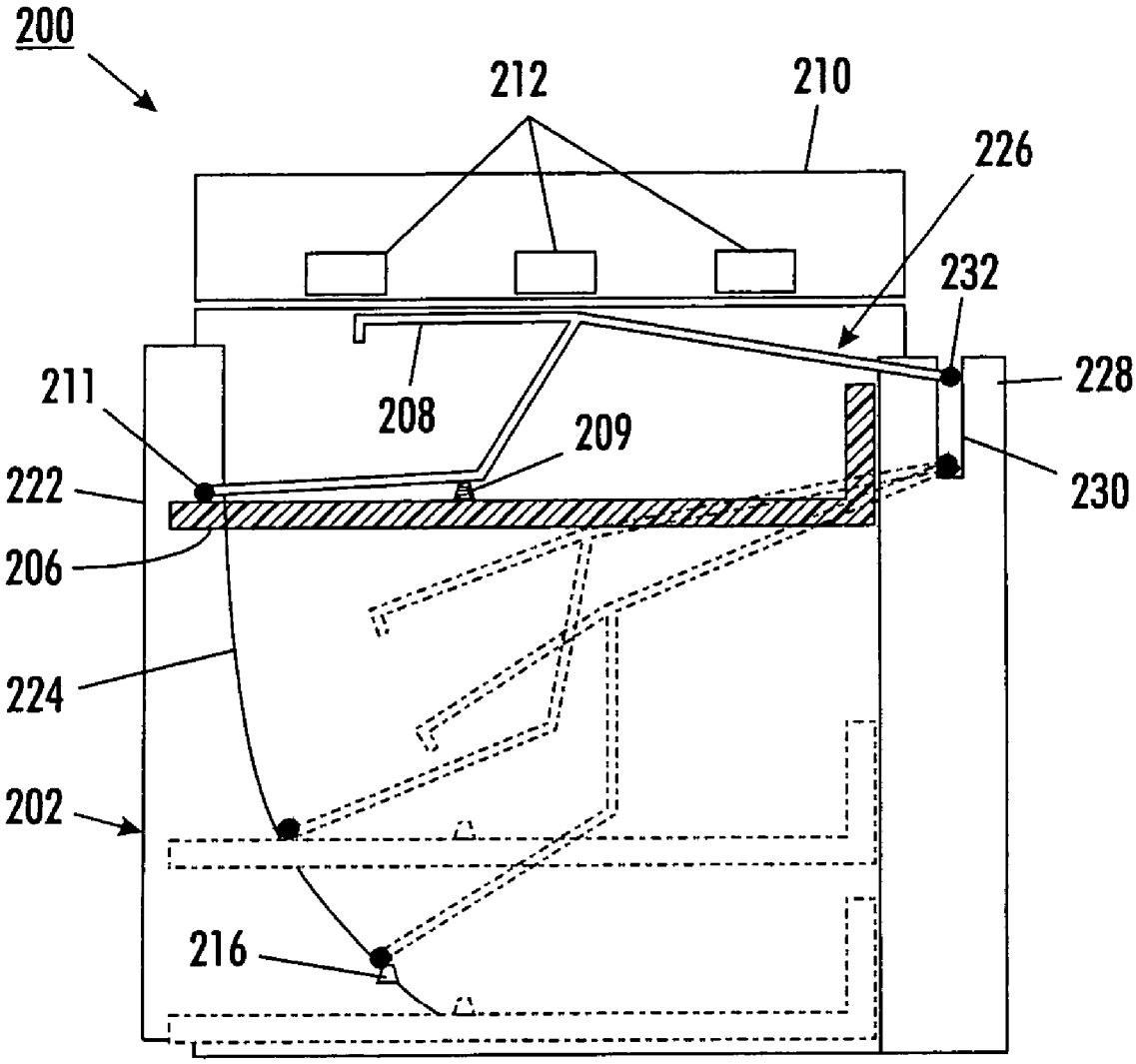
FIG. 7 shows an exemplary stacker tray.

FIG. 7 shows a stacker 200 for receiving outputs of machines such as printer machine 108. Stacker 200 may include a feeder 210 and a stacker tray 202. Feeder 210 may receive printed recording mediums (or objects) and feed them into stacker tray 202 using devices such as belt assemblies 212. Stacker tray 202 may include a stacker lift 206, a recording medium guide 222, which may include a guide surface 224, and an arm stop 216. Similar to feed tray 102, stacker tray 202 may include an arm 226 that pivots around a pivot 232 disposed at one end of arm 226 and include an arm glide 211 that rides on stacker lift 206. Arm 226 also may include a support spring 208 that flexibly support the recording mediums as they are stacked in stacker tray 202.

Stacker lift 206 may include an arm positioner 209 disposed to position arm 226 so that the recording mediums that are fed from feeder 210 may be properly received onto arm 226. As recording mediums are fed into stacker tray 202, stacker lift 206 may move downward. Initially, arm 226 may follow stacker lift 206 vertically because pivot guide 230 may be shaped into a vertical slot so that pivot 232 simply glides vertically downward without pivoting arm 226 to have an angular motion. However, when pivot 232 reaches a bottom portion of pivot guide 230, arm 226 may begin to rotate about pivot 232 and arm guide 211 may begin to slide against a top surface of stacker lift 206.

FIG. 7 shows an intermediate position of arm 226 and a lowest position of arm 226 where arm glide 211 is prevented from gliding further by arm stop 216. The lowest position of arm 226 may be determined based on maximum weight that can be accommodated or that can be safely removed from the stacker 202, for example.

Figure 8:
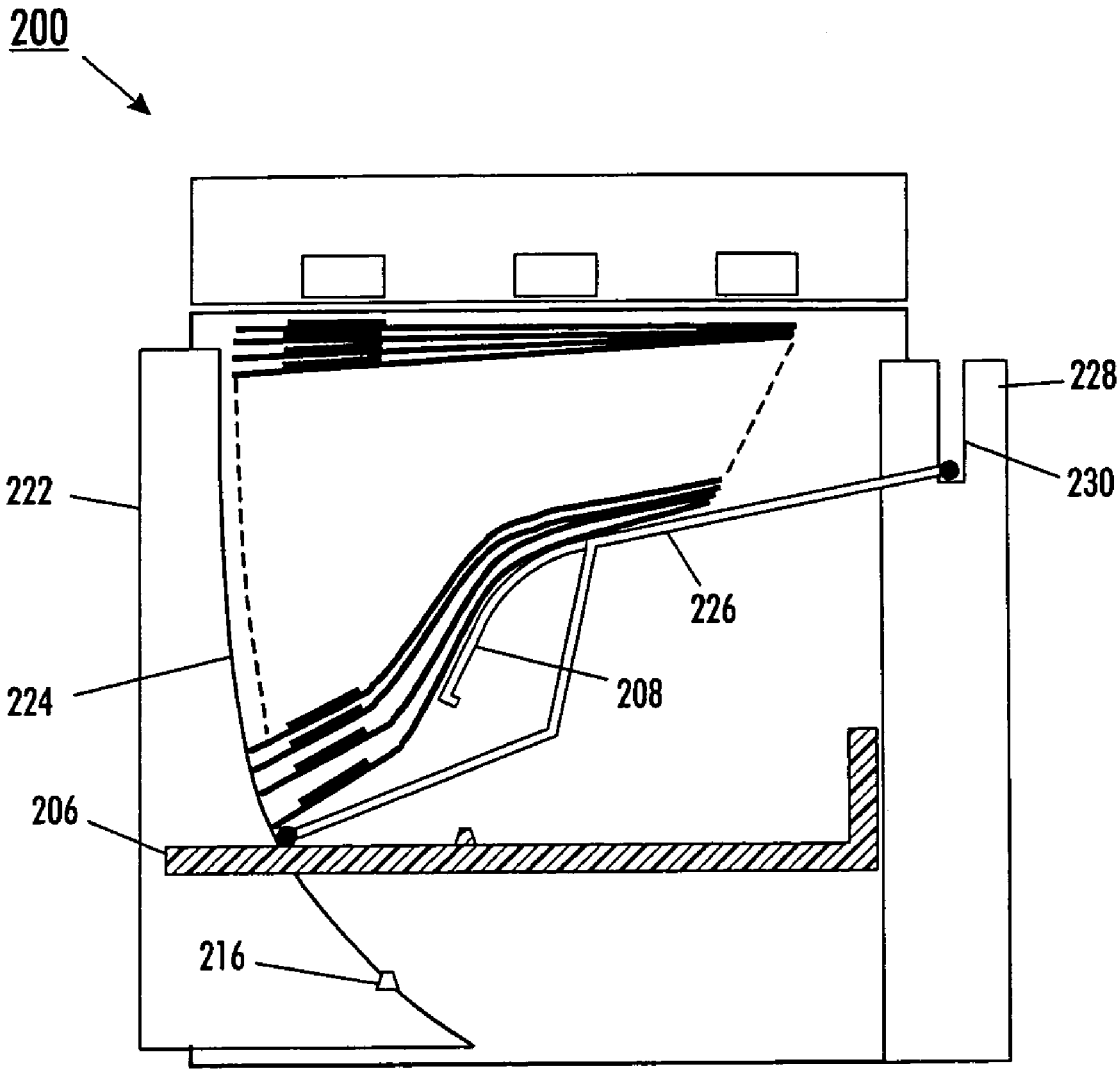
FIG. 8 shows the stacker tray having a stack of docucards, as an example.

FIG. 8 shows stacker tray 202 with arm 226 in an intermediate position and recording mediums such as docucards 118 stacked above arm 226. As shown, the left edges of docucards 118 are pressed against guide surface 224 of recording medium guide 222. Additionally, support spring 208 may be bent downwards allowing docucards 118 to be gently lowered into a rest position above arm 226.

Guide surface 224 may be formed to have a convenient shape such as the curve shown in FIG. 8. As shown, docucards laying above arm 226 are forced into a desirable alignment so that when removed, docucards 118 may be in a desirable stacked position ready for further processing.

Figure 9:
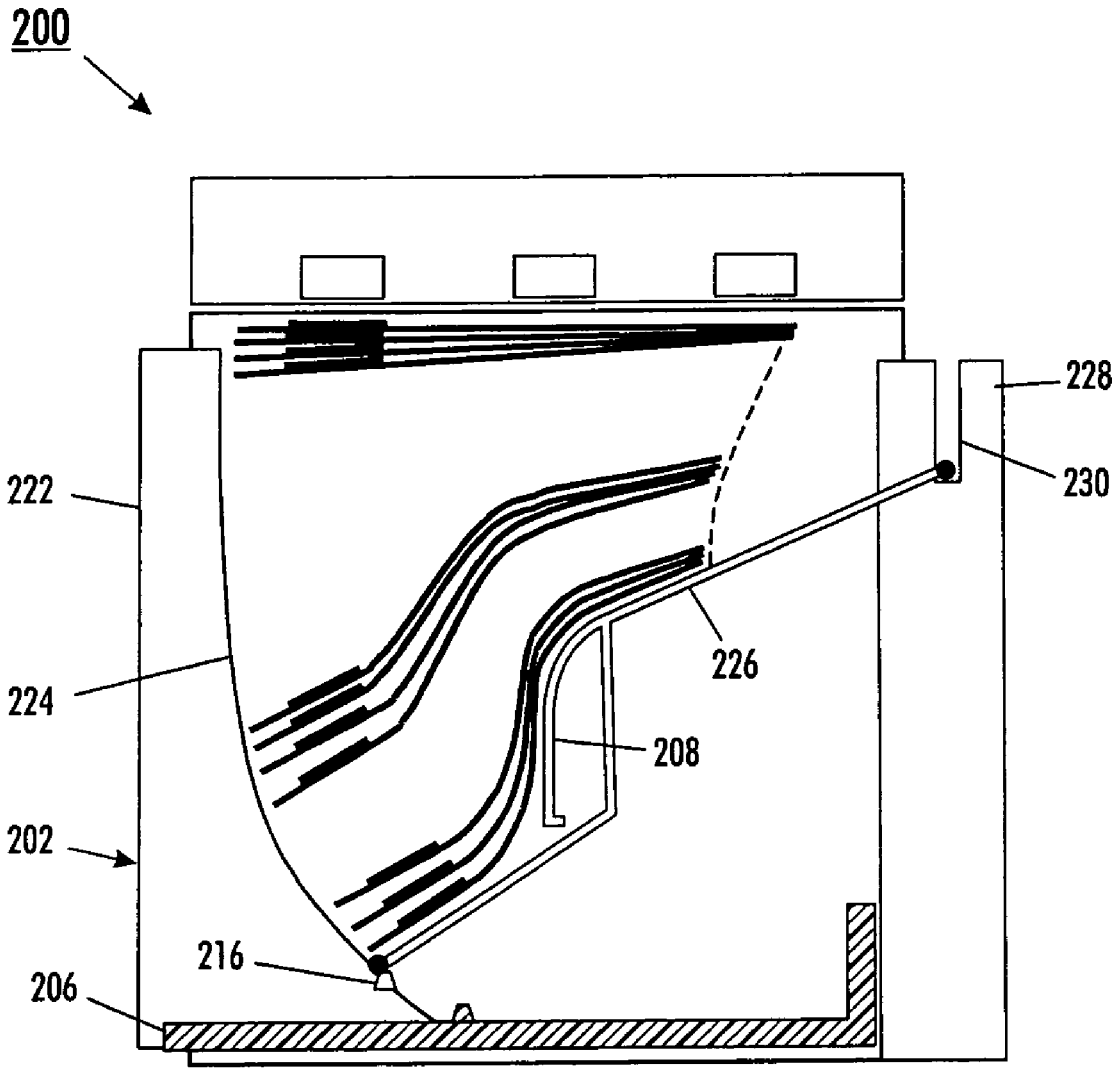
FIG. 9 shows the stacker tray stacked with a maximum number of docucards.

FIG. 9 shows arm 226 in its lowest position with arm glide 211 pressed against arm stop 216. Support spring 208 is pressed by the weight of docucards 118 and bent almost against the main body of arm 226.

Figure 10:
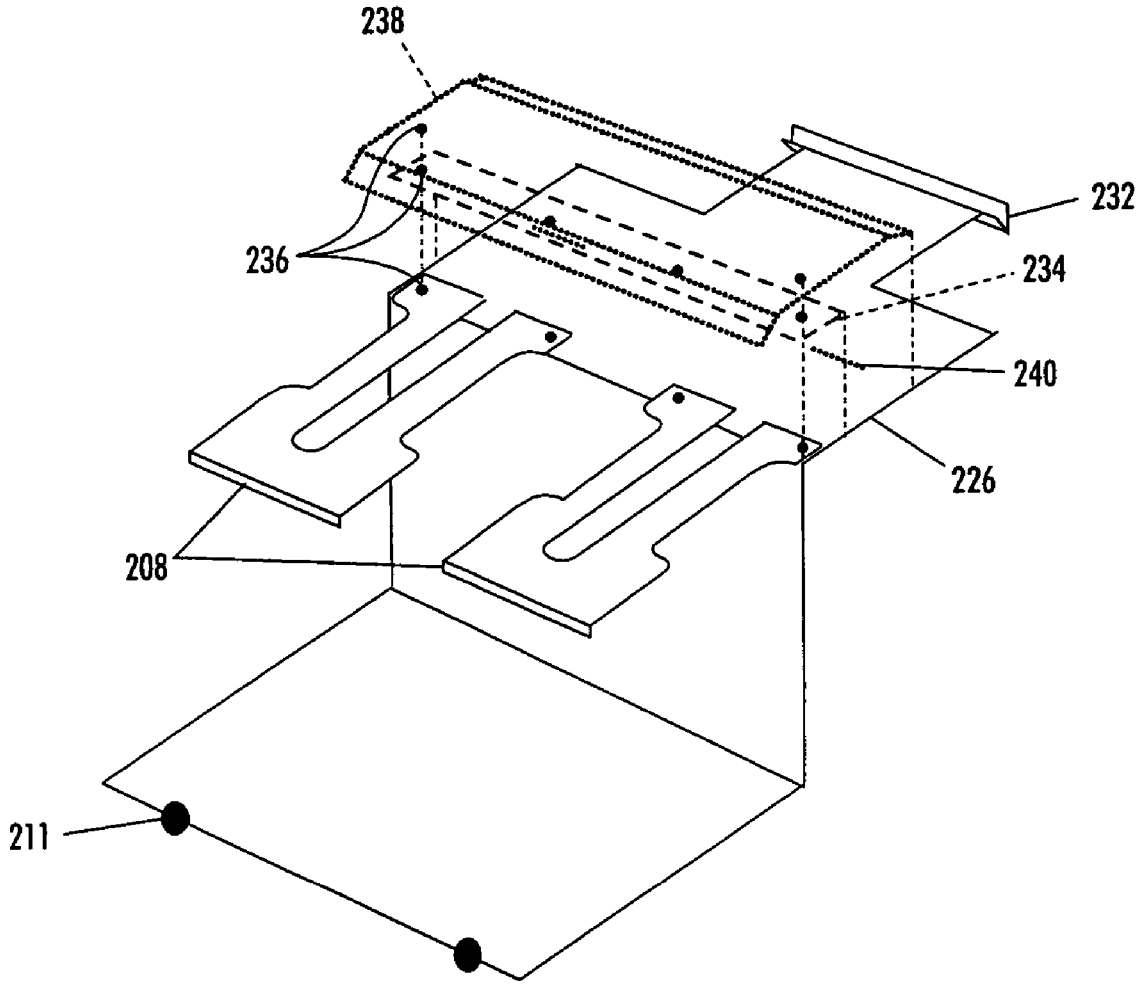
FIG. 10 shows a perspective view of a specific arm for the stacker tray.

FIG. 10 shows a specific configuration of arm 226. Pivot 232 may be formed by a bend of one end of arm 226 and at the opposite end of arm 226, arm glide 211 may be another bend of the arm 226 or any device that may be used to provide a suitable glide surface such as represented in FIG. 10. Arm glide 211 may be rollers or suitable round surfaces for gliding on the top surface of stacker lift 206. Support spring 208 may have two portions as shown in FIG. 10 having a bend at the free ends to stiffen the outer edge of support spring 208. Support spring 208 may be mounted onto the main body of arm 226 using a plate 234 and fasteners via fastener holes 236. Additionally, a cover plate 238 may be disposed over the plate 234 covering portions of support spring 208 near its attachment end to protect support spring 208 and to provide a smooth surface for recording mediums such as docucards 118 to lay on top of arm 226 and spring 208. The cover plate 238 may extend toward the free ends of support spring 208, past the vertical edge of the main body of arm 226 to prevent the recording mediums such as docucards 118 from tipping in the arm 226 and causing a jam or miss-registration in the print machine 108, for example.

While the above examples related to objects such as docucards 118, objects may have other properties that may cause non-uniform thickness across the surface. For example, transparencies may have a tab on one edge that is of different thickness than other portions of the transparency. Thus, when transparencies are stacked in feed tray 102 or stacker tray 202, one edge of the transparency stacks higher than the opposing edge causing possible feed difficulties. However, if arm 126 and spacer 136 are used as shown in FIG. 5, the top surface of the top transparency may be maintained in a desirable position relative to feeder 110 for proper feeding. Similarly, stacker tray 202 may be used to accommodate printed transparencies.

Non-uniform thickness of processed recording mediums may be introduced by the recording medium processor itself. For example, a printer machine or a copier machine may provide a staple option where multiple processed recording mediums may be stapled together at the top left corner, for example. When such stapled documents are stacked in a stacker tray, the stapled corner of the recording mediums stack higher than other portions of the stapled recording mediums thus limiting a number of stapled documents that may be received by a stacker tray before stacking difficulties are introduced.

Figure 11:
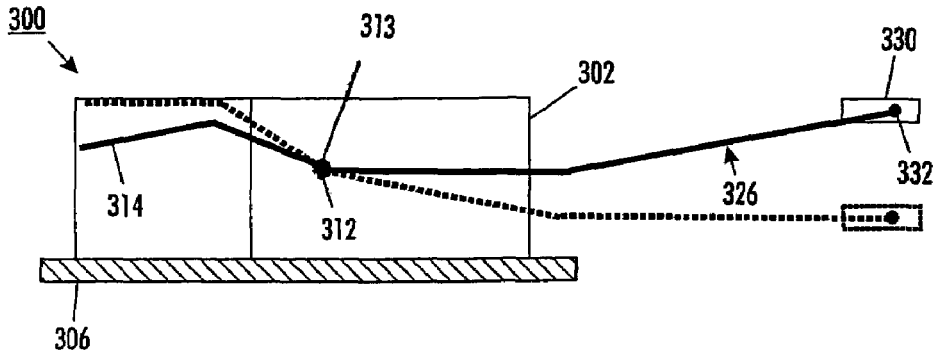
FIG. 11 shows an exemplary stacker tray for stacking documents having a thicker corner such as stapled documents.
Figure 12:
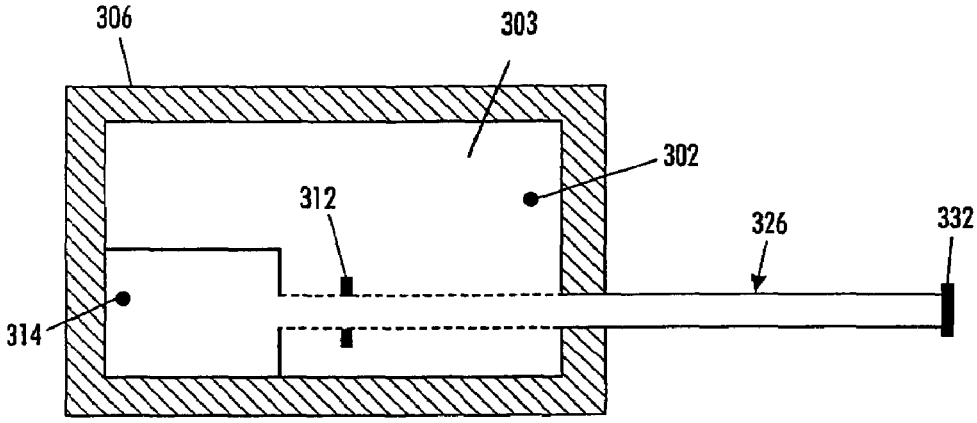
FIG. 12 shows an exemplary top view of the stacker tray shown in FIG. 11.

FIGS. 11 and 12 show an exemplary arm 326 that may be configured to accommodate non-uniform thickness limited to a particular portion such as a stapled corner of a recording medium. FIG. 11 shows a stacker tray 300 that may include stacker lift 306, spacer 302, arm 326, which may include pivots 312 and 332, and a recording medium support 314. Pivot 332 may be guided by pivot guide 330 and pivot 312, at a reference position 313, may be disposed in a fixed position relative to spacer 302. For clarity, only the above-noted portions of stacker tray 300 are shown without showing other portions that may be similar to that discussed above and shown in FIGS. 7-10.

When stacker lift 306 is at its uppermost position, arm 326 may be at a position represented by the dotted version of arm 326. As stacker lift 306 moves downward, arm 326 rotates about pivot 332 and pivot 312 so that recording medium support moves downward at a faster rate than top surface of spacer 302. The rate of movement of recording medium support 314 may be adjusted by positioning pivots 312 and 332 and adjusting lengths of arm 326 between pivots 312 and 332 as well as length of recording medium support 314 from pivot 312.

FIG. 12 shows a top view of stacker tray 300. The spacer 302 has a top surface with an opening forming one corner of the top surface. The recording medium support 314 is shaped to fit the corner of the top surface. Assuming for discussion that the recording medium is approximately the size of the top surface of spacer 302, recording medium support 314 supports only a corner of recording mediums laying above spacer 302 and recording medium support 314, by filling the opening of the corner of the top surface. Thus, as stacker lift 306 moves in a downward direction, recording medium support 314 moves downward at a faster rate than the top surface of spacer 302 thus accommodating the additional thickness introduced by stapling multiple recording mediums together. In this way, arms such as arm 326, 226 and/or 126 may be used to accommodate non-uniform thicknesses of recording mediums so that a top surface of a stack of recording mediums (or objects) may be maintained at a desired position.

While the shape of recording medium support 314 is shown to be substantially rectangular, other geometries may be used as may be appropriate. For example, substantially triangular shape may be used for stapled documents.

It would appreciated that various of the above-disclosed and other features and functions or alternatives thereof, may be desirably combined into many other different systems or applications. Also, that various presently unseen or unanticipated alternatives, modifications, variations or improvements therein may be subsequently made by those skilled in the art which are also intended to be encompassed by the following claims.

What is claimed is:

1. A tray system, comprising:

a tray comprising:

an object support, portions of the object support movable in a substantially linear tray movement direction at substantially different rates;

an arm having a first end and a second end;

a first pivot disposed at the first end and the object support disposed at the second end;

a tray lift that moves upward and downward;

a spacer supported by the tray lift and disposed between the tray lift and the object support, the spacer having a rectangular top surface with an opening forming one corner of the top surface, the object support including a rectangular recording medium support being shaped to fit the corner of the top surface; and a feeder disposed above the tray, wherein the tray system comprises a second pivot disposed on the arm and on the spacer to (1) move the portions of the object support at the substantially different rates to accommodate a reduction in a number of objects on the tray, and (2) maintain a planar surface of an object that is topmost substantially beneath and parallel to a surface of the feeder, so that contact is provided between the topmost object and the feeder to achieve a feeding process, as one or more objects are removed from the tray, when the tray lift is at an uppermost position, the recording medium support fills the opening of the corner of the top surface, and as the tray lift moves downward, the arm rotates so that the recording medium support moves downward at a faster rate than the top surface.

2. The tray system of claim 1, further comprising:

a reference position of the arm that moves substantially at a same rate as the tray lift.

3. The tray system of claim 2 further comprising:

a pivot guide, the first pivot movably coupled to move along the pivot guide in a translational motion, wherein the tray system is configured so that the pivot guide has a surface that bounds movements of the first pivot, the first pivot moving along the pivot guide in the translational motion as the tray lift moves to accommodate the reduction in the number of objects on the tray, as the objects are removed from the tray.

4. The tray system of claim 3, wherein the pivot guide is shaped to bound the movements of the pivot to obtain a desired position of the topmost object.

5. The tray system of claim 4, the topmost object being a docucard and the desired position being substantially flat relative to the feeder, the feeder feeding the docucard into a processing machine.

6. The tray system of claim 3, the first pivot being a cam and the surface being a cam riding surface, the first pivot riding on the surface of the pivot guide being pressed against the surface of the pivot guide by at least a weight of the arm.

7. The tray system of claim 2, further comprising:

an outer end of the object support, the outer end, the spacer and the tray lift moving substantially at the same rate.

8. The tray system of claim 3, wherein the spacer is disposed on a surface of the tray lift; and the first pivot is capable of rotating about a substantially fixed position relative to the spacer, the arm rotating about the first pivot when the tray lift moves in the substantially linear tray movement direction.

9. The tray system of claim 1, wherein the tray system is further configured so that the arm simultaneously and substantially moves in both translational and rotational manners, to accommodate the reduction in the number of objects on the tray, as the one or more objects are removed from the tray.

10. A xerographic device comprising the tray system of claim 1, the xerographic device being one or more of a copier or a printer.

11. A tray system, comprising:

means for moving different portions of stacked objects in a linear movement direction at different rates, comprising:

a tray lift;

an arm;

an object support;

a spacer disposed between the tray lift and the object support, the spacer having a rectangular top surface with an opening forming one corner of the top surface;

the object support including a rectangular recording medium support being shaped to fit the corner of the top surface; and means for feeding objects, wherein the tray system is configured to (1) move different portions of the means for moving different portions of stacked objects, corresponding to the different portions of stacked objects, at the different rates to accommodate a reduction in the number of stacked objects on the means for moving different portions of stacked objects, and (2) maintain a planar surface of whichever stacked object is topmost substantially beneath and parallel to a surface of the means for feeding objects, so that contact is provided between the topmost stacked object and the feeding means to achieve a feeding process, as one or more stacked objects are removed from the means for moving different portions of stacked objects, when the tray lift is at an uppermost position, the recording medium support fills the opening of the corner of the top surface, and as the tray lift moves downward, the arm rotates so that the recording medium support moves downward at a faster rate than the top surface.

12. A tray system, comprising:

a tray, comprising:

an arm having a first end and a second end;

a first pivot disposed at the first end;

an object support disposed at the second end;

a tray lift that moves upward and downward;

a spacer supported by the tray lift and disposed between the tray lift and the object support, the spacer having a rectangular top surface with an opening forming one corner of the top surface, the object support including a rectangular recording medium support being shaped to fit the corner of the top surface; and a feeder, wherein the tray system comprises a second pivot disposed on the arm and on the spacer to (1) move different portions of the tray at different rates to accommodate a reduction in the number of objects on the tray, and to (2) maintain a planar surface of whichever object is topmost substantially beneath and parallel to a surface of the feeder, so that contact is provided between the topmost object and the feeder to achieve a feeding process, as one or more objects are removed from the tray, when the lift is at an uppermost position, the recording medium support fills the opening of the corner of the top surface, and as the lift moves downward, the arm rotates so that the recording medium support moves downward at a faster rate than the top surface.

* * * * *